United States Patent [19]

Jackson

[11] Patent Number: 4,679,887

[45] Date of Patent: Jul. 14, 1987

[54] ELECTRICAL TERMINAL

[75] Inventor: Charles L. Jackson, Nr. Tonbridge, England

[73] Assignee: AMP Incorporated, Harrisburg, Pa.

[21] Appl. No.: 361,295

[22] Filed: Mar. 24, 1982

[51] Int. Cl.[4] ..... H01R 11/22

[52] U.S. Cl. ..... 439/849

[58] Field of Search ..... 339/256 SP, 258 S, 74 R

[56] References Cited

U.S. PATENT DOCUMENTS

| | | | |
|---|---|---|---|
| 2,591,009 | 4/1952 | Riche | 339/256 SP |
| 3,097,906 | 7/1963 | Shannon | 339/256 SP |
| 3,188,606 | 6/1965 | De Lyon et al. | 339/256 SP |
| 3,550,069 | 12/1970 | Teagno | 339/256 SP |
| 3,920,310 | 11/1975 | Walsh et al. | 339/256 SP |
| 3,976,348 | 8/1976 | Simmons | 339/258 S |
| 4,260,216 | 4/1981 | Ackerman | 339/258 S |

FOREIGN PATENT DOCUMENTS 2853512 6/1979 Fed. Rep. of Germany .

*Primary Examiner*—Gil Weidenfeld
*Assistant Examiner*—P. A. Austin
*Attorney, Agent, or Firm*—Allan B. Osborne

[57] ABSTRACT

This invention relates to an electrical terminal, and particularly to an electrical terminal for mating with a flat tab male terminal and having a receptacle portion comprising a base and a pair of opposed side walls upstanding from the base, free edge portions of the side walls being turned-in over the base whereby the base, side walls and free edge portions together define a passage to receive from one end a flat tab male terminal.

3 Claims, 5 Drawing Figures

FIG.1.
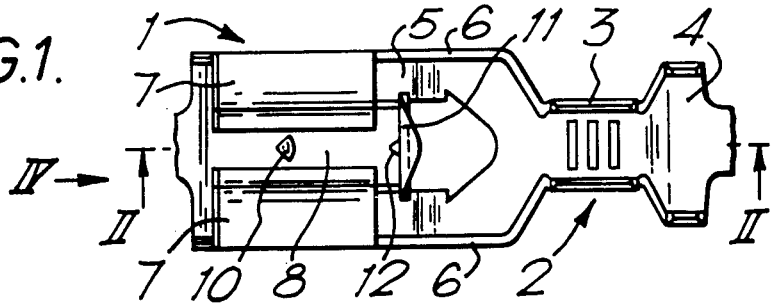
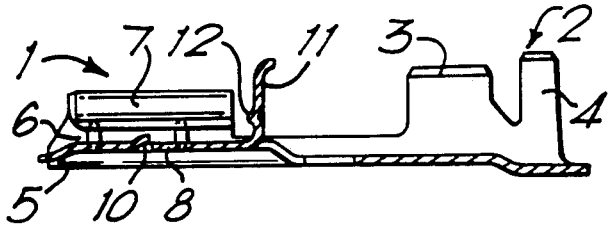
FIG.2.
FIG.3.
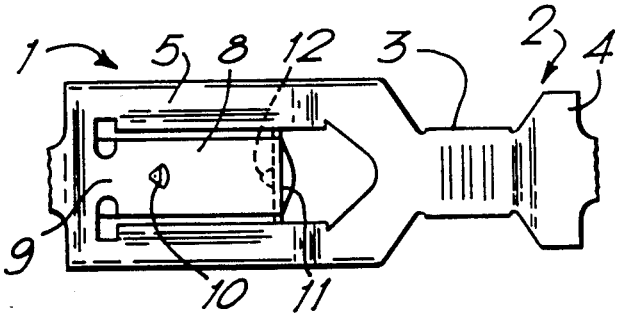
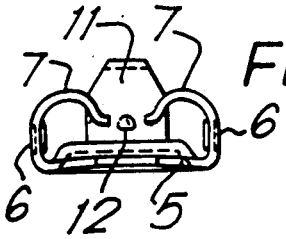
FIG.4.
FIG.5.
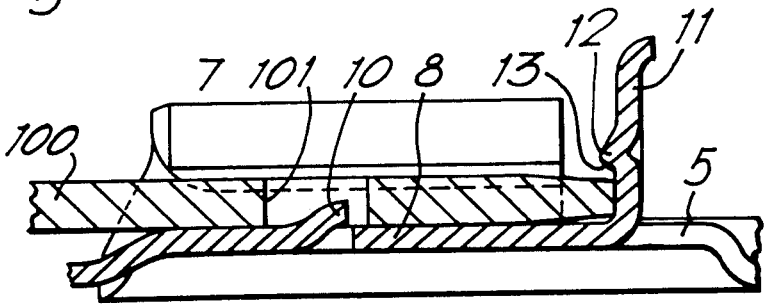

ELECTRICAL TERMINAL

This invention relates to an electrical terminal, and particularly to an electrical terminal for mating with a flat tab male terminal and having a receptacle portion comprising a base and a pair of opposed side walls upstanding from the base, free edge portions of the side walls being turned-in over the base whereby the base, side walls and free edge portions together define a passage to receive from one end a flat tab male terminal.

In British Patent Specification No. 1463751 there is described such a terminal which has the advantages that when mated with a male tab it becomes locked thereto against accidental disconnection, but which is provided with an integral release member by operation of which the locking can be released when required to allow for disconnection. In particular, the receptacle portion of the terminal has an integrally formed tongue extending from the tab-entry end of the base and within the receptacle portion, the tongue having a projection arranged to engage in a hole in a male tab when mated with the terminal to provide the locking, a free end portion of the tongue projecting away from the base to provide the release member, depression of the release member towards the base serving to release the projection on the tongue from the hole in the male tab and thus allow disconnection.

Such known electrical terminals have achieved considerable commercial success throughout the world since they were introduced some years ago.

However, some difficulties have been encountered when the terminals are mated with male tabs not provided with shoulders serving to limit insertion of the male tab into the receptacle portion of the terminal. Many male tabs are formed with shoulders which engage the side walls of the receptacle portion on mating of the male tab with a terminal as described, this engagement serving to limit insertion of the male tab into the receptacle portion, and thus prevent damage to the receptacle portion, and in particular the tongue and release member thereof. If a male tab without such shoulders is used then it is possible for the male tab to be over inserted into the receptacle portion such that the leading end of the male tab engages and bends the release member back towards alignment with the remainder of the tongue thus causing permanent damage to the release member and rendering the terminal useless.

According to this invention, in an electrical terminal as set out above the release member is formed with a projection directed towards the tab entry end of the receptacle portion and positioned such that the leading end of a male tab being mated with the terminal will engage the release member between the root of the tongue and the projection, the projection serving to prevent movement of the free end of the male tab along the release member towards the free end thereof and thus limit insertion of the male tab into the receptacle portion.

Thus, in the terminal of this invention over-insertion of a male tab into the receptacle portion is prevented by engagement between the free end of the male tab and the projection on the release member, since for insertion of the male tab beyond this point it is necessary for the free end of the male tab to pass along the release member towards the free end thereof and such movement is prevented by the projection on the release member. The release member cannot therefore be bent and damaged by over-insertion of the male tab, and the terminal can successfully be used with male tabs with or without insertion-limiting shoulders as discussed above.

An electrical terminal according to this invention will now be described by way of example with reference to the drawings, in which:

FIG. 1 is a top plan view of the terminal;

FIG. 2 is a sectional view on the line II—II in FIG. 1;

FIG. 3 is an underneath plan view of the terminal;

FIG. 4 is a view in the direction of the arrow IV in FIG. 1; and

FIG. 5 shows the receptacle portion of the terminal with a male tab mated therewith.

The terminal to be described is basically of a well known type and will not therefore be described in great detail.

The terminal is for mating with a flat tab male terminal 100 (FIG. 5) of conventional type having a hole 101 therein, and is stamped and formed from sheet metal to comprise a receptacle portion 1 for receiving the male tab 100, and a wire connection portion 2 of known form and comprising a first ferrule 3 for crimping about the conductive core of an insulated wire and a second ferrule 4 for crimping about the insulation of the wire, in known manner.

The receptacle portion 1 comprises a base 5 and a pair of opposed side walls 6 upstanding from the base 5, free edge portions 7 of the side walls 6 being rolled-in over the base 5 whereby the base 5, side walls 6 and free edge portions 7 together define a passage to receive from one end (left-hand end in FIGS. 1 to 3) a flat tab male terminal (100 in FIG. 5).

A tongue 8 is stamped from the base 5 and extends axially from its root 9 at the tab-entry end of the receptacle portion 1 rearwardly within the receptacle portion 1, the tongue 8 having a lance projection 10 arranged to engage in a hole (101 in FIG. 5) in a male tab when mated with the terminal to lock the male tab to the terminal and thus prevent accidental disconnection, as described more fully in British Patent Specification No. 1463751.

The tongue 8 extends rearwardly beyond the rearward ends of the free edge portions 7 and a free end portion thereof is then bent to project away from the base 5 to provide a release member 11 by depression of which towards the base 5 the lance 10 on the tongue 8 can be released from the hole in the male tab to allow disconnection, again as described in British Patent Specification No. 1463751.

The release member 11 is formed with a projection 12 directed towards the tab-entry end of the receptacle portion 1 and positioned, as clearly shown in FIG. 5, such that the leading end of the male tab 100 being mated with the terminal engages the release member 11 between the root 9 of the tongue 8 and the projection 12. The projection 12 can be formed by a simple indentation in the release member 11, but is preferably formed with half-shearing the material of the release member 11 whereby a positive shoulder 13 facing the base 5 of the receptacle portion 1 is formed on the projection 12.

Normally, and when a male tab 100 having insertion-limiting shoulders is mated with the terminal, kthe leading free end of the male tab 100 will not engage the release member 11, but the male tab 100 will be inserted only until the lance 10 on the tongue 8 engages in the hole 101 in the male tab 100 as necessary to lock the terminals together. However, when a male tab 100 without insertion-limiting shoulders is mated with the terminal it is possible that the male tab 100 will be over inserted such that the leading free end thereof engages the release member 11, as shown in FIG. 5. Thus, the release member 11 must act to limit insertion of the male tab 100 and there is, in known terminals not in accordance with this invention, the possibility that the male tab 100 will continue to be inserted, bending the release member 11 and thus damaging the terminal and rendering it useless.

The projection 12 on the release member 11 of the terminal of this invention serves to prevent such damage-causing over insertion of the male tab 100. For the male tab 100 to be further inserted beyond the position shown in FIG. 5 it is necessary for the free end of the male tab 100 to ride along the release member 11, and this is prevented by engagement of the free end of the male tab 100 with the projection 12 on the release member 11, and in particular in the embodiment shown in the drawings with the shoulder 13 provided by the projection 12.

The terminal of this invention is thus protected from damage caused by possible over-insertion of a male tab into the receptacle portion thereof.

Although in the embodiment described above the tongue 8 is stamped from the base 5 of the receptacle portion 1, it will be appreciated that the tongue 8 can otherwise be turned-back from the tab-entry end of the base 5 as shown in the terminal specifically described in British Patent Specification No. 1463751.

The terminal of this invention can be used in an uninsulated condition as shown in the drawings, or can otherwise be used in an insulating housing formed to co-operate with the release member of the terminal to effect release of the terminal from a male tab mated therewith, again as described in British Patent Specification No. 1463751.

I claim:

1. An electrical terminal for mating with a flat tab male terminal and having a receptacle portion comprising a base and a pair of opposed side walls upstanding from the base, free edge portions of the side walls being turned-in over the base whereby the base, side walls and free edge portions together define a passage to receive from one end a flat tab male terminal, there being an integrally formed tongue extending from the tab-entry end of the base and within the receptacle portion, the tongue having a projection arranged to engage in a hole in a male tab when mated with the terminal to lock the male tab to the terminal, a free end portion of the tongue projecting away from the base to provide a release member by depression of which towards the base the projection on the tongue can be released from the hole in the male tab to allow disconnection, the release member being formed with a projection directed towards the tab entry end of the receptacle portion and positioned such that the leading end of a male tab being mated with the terminal will engage the release member between the root of the tongue and the projection, the projection serving to prevent movement of the free end of the male tab along the release member towards the free end thereof and thus limit insertion of the male tab into the receptacle portion.

2. A terminal as claimed in claim 1, in which the projection on the release member is formed by a half-shear in the release member, and provides a shoulder facing the base of the receptacle portion.

3. A terminal as claimed in claim 1 or claim 2, in which the tongue is stamped from the base of the receptacle portion.

* * * * *